US008177932B2

(12) United States Patent
Becnel et al.

(10) Patent No.: US 8,177,932 B2
(45) Date of Patent: May 15, 2012

(54) METHOD FOR MANUFACTURING A MICRO TUBE HEAT EXCHANGER

(75) Inventors: Charles J. Becnel, Baton Rouge, LA (US); Jeffrey J. McLean, Baton Rouge, LA (US)

(73) Assignee: International Mezzo Technologies, Inc., Baton Rouge, LA (US)

( * ) Notice: Subject to any disclaimer, the term of this patent is extended or adjusted under 35 U.S.C. 154(b) by 420 days.

(21) Appl. No.: 12/540,985

(22) Filed: Aug. 13, 2009

(65) Prior Publication Data

US 2011/0024037 A1 Feb. 3, 2011

Related U.S. Application Data

(60) Provisional application No. 61/156,385, filed on Feb. 27, 2009, provisional application No. 61/224,002, filed on Jul. 8, 2009.

(51) Int. Cl.
*B32B 37/00* (2006.01)

(52) U.S. Cl. ..... 156/73.6; 156/293; 228/262.9

(58) Field of Classification Search ..... 156/73.5, 156/73.6, 293; 264/68, 69; 228/262.9
See application file for complete search history.

(56) References Cited

U.S. PATENT DOCUMENTS

| | | | |
|---|---|---|---|
| 2,298,996 | A | 10/1942 | Woods |
| 2,389,175 | A | 11/1945 | Woods |
| 2,496,301 | A | 2/1950 | Meixl |
| 2,537,024 | A | 1/1951 | Bay |
| 3,376,028 | A | 4/1968 | Leason et al. |
| 3,391,042 | A | 7/1968 | Schimpf |
| 3,603,384 | A | 9/1971 | Huggins et al. |
| 3,727,029 | A | 4/1973 | Chrow |
| 3,750,709 | A | 8/1973 | French |
| 3,782,457 | A | 1/1974 | Troy |

(Continued)

FOREIGN PATENT DOCUMENTS

| | | |
|---|---|---|
| EP | 0097612 A2 | 1/1984 |

(Continued)

*Primary Examiner* — James Sells
(74) *Attorney, Agent, or Firm* — McGlinchey Stafford, PLLC; R. Andrew Patty, II

(57) ABSTRACT

A method including disposing a first end plate adjacent to a second end plate, wherein the first end plate and second end plate each define a pattern of apertures. The first end plate is aligned with the second end plate such that the pattern of apertures in the first end plate is substantially aligned with the pattern of apertures in the second end plate. The method includes placing an end portion of each of a plurality of micro tubes in contact with the first end plate, the micro tubes being substantially vertically disposed and substantially perpendicular to a top surface of the first end plate, so as to place the micro tubes on the first end plate, and vibrating at least one of the micro tubes while the micro tubes are on the first end plate, thereby causing the micro tubes to insert into and through respective aligned apertures of the patterns of apertures in the first end plate and the second end plate. The method further includes separating the first end plate from the second end plate while the micro tubes extend therethrough, until the first end plate and the second end plate are disposed proximate to respective end portions of the micro tubes extending therethrough, and affixing each end portion of the micro tubes to a respective end plate, thereby forming a pathway in a micro tube heat exchanger component for the flow of an internal fluid to be heated or cooled by external flow of an external fluid.

21 Claims, 12 Drawing Sheets

U.S. PATENT DOCUMENTS 3,837,397 A 9/1974 Pettigrew
3,849,854 A 11/1974 Mattioli et al.
3,853,149 A 12/1974 Stine
3,889,745 A 6/1975 Siemonsen
4,053,969 A 10/1977 Bayard
4,054,239 A 10/1977 Watson, Jr.
4,054,980 A 10/1977 Roma
4,056,143 A 11/1977 Martin
4,117,884 A 10/1978 Frei
4,194,536 A 3/1980 Stine et al.
4,253,519 A 3/1981 Kun et al.
4,355,684 A 10/1982 Caines
4,421,160 A 12/1983 Stafford et al.
4,495,987 A 1/1985 Finnan
4,528,733 A 7/1985 Lord
4,574,444 A 3/1986 Humpolik
4,633,056 A 12/1986 Schlosser
4,676,305 A 6/1987 Doty
4,689,465 A 8/1987 Pál
4,735,261 A 4/1988 Huebner
4,749,117 A 6/1988 Noe et al.
4,766,953 A 8/1988 Grieb et al.
4,787,443 A 11/1988 Fukatsu et al.
4,815,535 A 3/1989 Hagemeister
4,839,950 A 6/1989 Stroup
4,848,448 A 7/1989 Kaarre
4,871,014 A 10/1989 Sulzberger
4,896,410 A 1/1990 Spitzmesser et al.
4,901,792 A 2/1990 Komiya
4,928,755 A 5/1990 Doty et al.
4,972,903 A 11/1990 Kwok
4,979,665 A 12/1990 Gruene et al.
4,986,344 A 1/1991 Maier
5,002,119 A 3/1991 Geppelt et al.
5,004,042 A 4/1991 McMorries, IV et al.
5,058,266 A 10/1991 Knoll
5,067,235 A 11/1991 Kato et al.
5,121,791 A 6/1992 Casterline
5,133,492 A 7/1992 Wohrstein et al.
5,154,679 A 10/1992 Fuller et al.
5,174,372 A 12/1992 Potier et al.
5,199,487 A 4/1993 DiFrancesco et al.
5,226,234 A 7/1993 Beddome et al.
5,226,235 A 7/1993 Lesage
5,236,336 A 8/1993 Hitoshi
5,238,057 A 8/1993 Schelter et al.
5,251,693 A 10/1993 Zifferer
5,267,605 A 12/1993 Doty et al.
5,274,920 A 1/1994 Matthews
5,295,532 A 3/1994 Hughes
5,309,637 A 5/1994 Moriarty
5,317,805 A 6/1994 Hoopman et al.
5,327,957 A 7/1994 Killebrew
5,327,959 A 7/1994 Saperstein et al.
5,355,946 A 10/1994 Wei et al.
5,373,895 A 12/1994 Yamamoto et al.
5,464,057 A 11/1995 Albano et al.
5,472,047 A 12/1995 Welkey
5,529,816 A 6/1996 Sartini et al.
5,544,698 A 8/1996 Paulman
5,604,981 A 2/1997 Frazier et al.
5,611,877 A 3/1997 Yoshida et al.
5,690,169 A 11/1997 Foerster
5,704,415 A 1/1998 Suzuki et al.
5,709,028 A 1/1998 Kreutzer et al.
5,746,270 A 5/1998 Schroeder et al.
5,899,263 A 5/1999 Tokutake
6,131,617 A 10/2000 Pitzer et al.
6,146,470 A 11/2000 Paulman
6,149,422 A * 11/2000 Cesaroni ..... 425/509
6,155,340 A 12/2000 Folkedal et al.
6,167,951 B1 1/2001 Couch et al.
6,180,038 B1 1/2001 Cesaroni
6,192,976 B1 2/2001 Yoshida et al.
6,206,086 B1 3/2001 McKey
6,253,571 B1 7/2001 Fujii et al.
6,269,871 B1 * 8/2001 Nishio et al. ..... 165/173
6,302,197 B1 10/2001 Hornby et al.
6,364,008 B1 4/2002 Mannoni et al.
6,365,114 B1 4/2002 Marold
6,460,610 B2 10/2002 Lambert et al.
6,536,255 B2 3/2003 Kraft
6,604,669 B1 8/2003 Syslak et al.
6,620,969 B1 9/2003 Nishimura et al.
6,626,235 B1 9/2003 Christie
6,705,391 B1 3/2004 Lewin
6,712,131 B1 3/2004 Brinkman et al.
6,745,459 B2 6/2004 Tokunaga et al.
6,772,830 B1 8/2004 Larsen et al.
6,772,832 B2 8/2004 Schneider
6,779,591 B2 8/2004 Ehlers et al.
6,786,275 B2 9/2004 Dey et al.
6,808,017 B1 10/2004 Kaellis
6,827,139 B2 12/2004 Kawakubo et al.
6,871,774 B2 * 3/2005 DeSalve ..... 228/183
6,892,802 B2 5/2005 Kelly et al.
6,932,152 B2 8/2005 Iwasaki et al.
7,000,415 B2 2/2006 Daddis, Jr. et al.
7,003,879 B2 2/2006 Smith et al.
7,036,570 B2 5/2006 Korth et al.
7,066,243 B2 6/2006 Horiuchi et al.
7,089,998 B2 8/2006 Crook
7,111,669 B2 9/2006 Höglinger et al.
7,112,297 B2 9/2006 Williams et al.
7,128,137 B2 10/2006 Dilley et al.
7,128,138 B2 10/2006 Des Champs
7,198,096 B2 4/2007 Parish, IV et al.
7,234,511 B1 6/2007 Lesage
7,246,437 B2 7/2007 Damsohn et al.
7,255,156 B2 8/2007 Calton et al.
7,303,002 B2 12/2007 Usui et al.
7,322,400 B2 1/2008 Parish, IV et al.
8,006,750 B2 * 8/2011 Cesaroni ..... 165/178
2001/0034935 A1 11/2001 Pierce et al.
2002/0125004 A1 9/2002 Kraft
2003/0029040 A1 2/2003 Cesaroni et al.
2003/0127497 A1 7/2003 DeSalve
2003/0131976 A1 7/2003 Krause et al.
2003/0131981 A1 7/2003 Kohler et al.
2004/0003917 A1 1/2004 Bergevin et al.
2004/0049915 A1 3/2004 Dunand-Roux et al.
2004/0065433 A1 4/2004 Meshenky et al.
2004/0188076 A1 9/2004 Lee
2005/0103486 A1 5/2005 Demuth et al.
2005/0160589 A1 7/2005 Bowen et al.
2005/0172664 A1 8/2005 Cho et al.
2005/0241816 A1 11/2005 Shabtay et al.
2005/0269069 A1 12/2005 Hancock
2006/0054312 A1 3/2006 Kim et al.
2006/0118282 A1 6/2006 Ren et al.
2006/0130517 A1 6/2006 Merkys et al.
2006/0137181 A1 6/2006 Parish, IV et al.
2006/0137869 A1 6/2006 Steinhauser
2006/0175047 A1 8/2006 Hattori et al.
2006/0196052 A1 9/2006 Lesage
2006/0242831 A1 11/2006 Cesaroni
2006/0288725 A1 12/2006 Schlosser et al.
2007/0175620 A1 8/2007 Watanabe et al.
2008/0041571 A1 2/2008 Minami et al.
2008/0042306 A1 2/2008 Reinders
2008/0053646 A1 3/2008 Martin
2008/0121386 A1 5/2008 Hakamata et al.
2008/0149314 A1 6/2008 Tsou et al.
2008/0156014 A1 7/2008 Kopko et al.
2008/0210405 A1 9/2008 Datta et al.
2008/0229580 A1 9/2008 Anderson et al.

FOREIGN PATENT DOCUMENTS

EP 0176407 A1 4/1986
EP 0191602 A2 8/1986
EP 0641986 A1 3/1995
EP 0802383 A2 10/1997
EP 0805331 A2 7/1998
GB 557671 11/1943
GB 806343 12/1958
GB 1040284 8/1966
GB 1107843 3/1968

| | | | |
|---|---|---|---|
| GB | 1141102 | | 1/1969 |
| GB | 1197084 | | 7/1970 |
| GB | 1362052 | | 7/1974 |
| GB | 1551106 | | 8/1979 |
| JP | 09053891 | A | 2/1997 |
| JP | 11002496 | A | 1/1999 |
| JP | 2002039696 | A | 2/2002 |
| JP | 2005037054 | A | 2/2005 |
| JP | 2005127597 | A | 5/2005 |
| JP | 2005257094 | A | 9/2005 |
| JP | 2006132819 | A | 5/2006 |
| JP | 2006194476 | A | 7/2006 |
| WO | WO 03031050 | A1 | 4/2003 |
| WO | WO 2005065813 | A1 | 7/2005 |

* cited by examiner

METHOD FOR MANUFACTURING A MICRO TUBE HEAT EXCHANGER

The U.S. Government has provided support for the making of, and has certain rights in, this invention as provided for by the terms of Contract No. N68335-08-C-0127 awarded by the U.S. Department of the Navy.

REFERENCE TO RELATED APPLICATIONS

A claim is made to the benefit of the priorities of U.S. patent application Ser. No. 61/156,385, filed on Feb. 27, 2009, and U.S. patent application Ser. No. 61/224,002 filed on Jul. 8, 2009, the disclosures of which are incorporated herein by reference.

TECHNICAL FIELD

This invention relates to a method for manufacturing heat exchangers, particularly heat exchangers comprising micro tubes.

SUMMARY OF THE INVENTION

Heat exchangers are used to transfer energy from one fluid to another. Heat exchangers are typically characterized by heat transfer rates between fluids and corresponding pressure drops of the fluid(s) across the heat exchanger. Examples of other performance metrics include volume, weight, cost, durability, and resistance to fouling. Micro tube heat exchangers are effectively shell and tube heat exchangers where the outer tube diameter is very small (diameters less than about 1.5 mm, and preferably less than 1.0 mm) compared to what has been used extensively in industry (outer tube diameters greater than 3 mm). Micro tube heat exchangers commonly utilize thousands, tens of thousands, or even millions of tubes. Micro tubes may be defined as tubes, each having an outer diameter of less than about 1.5 mm, and preferably less than one (1) mm.

There are advantages to using micro tubes which include more heat exchange area per unit volume, higher heat transfer coefficients, and an enhanced ratio of heat transfer/pressure drop associated with very low Reynolds numbers, all of which lead to greatly enhanced heat transfer/volume, heat transfer/weight (so called compact heat exchangers) and thermal performance. However, a challenging component in manufacturing micro tube heat exchangers is the manufacture of the header plates and/or mid plates. Each header plate and mid plate typically will contain an identical pattern of holes, numbering in the thousands, tens of thousands, or millions, corresponding to the thousands, tens of thousands, or even millions of tubes. The precision of the hole spacing and the diameter of the holes must be within tight enough tolerances such that the tubes easily can pass through the header plates and mid plates during the manufacture process, yet also provide a tight clearance (on the order of 0.001-0.004 inches (0.0025-0.01 mm) diametrical clearance) desired for the bonding/sealing process associated with either brazing, soldering, or adhesive gluing. The thickness of the header plates is typically much thicker than the mid plates, since the structural loads imposed on header plates are much greater. One known method to manufacture header plates and mid plates is to drill the appropriate hole pattern in each plate. This process has been used successfully to fabricate heat exchangers, but it is expensive since the time and resources required to drill thousands to millions of holes in each of the header plates and mid plates is significant. Furthermore, when structural loads dictate that the header must be relatively thick (greater than about five times the hole diameter), the process to drill holes becomes substantially longer. If the application requires hard-to-drill materials such as 304 stainless steel, a nickel alloy such as INCONEL®, or titanium (as opposed to an easy-to-drill material such as many aluminum alloys), hole drilling is even more expensive and time consuming.

Another challenging component in manufacturing micro tube heat exchangers is the process of joining the thousands, tens of thousands, or millions of micro tubes to the header plates. While micro tube heat exchangers are typically more compact than heat exchangers using tubes with larger diameter, the number of tubes is typically much greater for a given application. Because the number of tubes in a micro tube heat exchanger can number tens of thousands, even millions, it is important that the process used to join the tubes to the header plates be extremely reliable. A preferable joint provides structural integrity and prevents leakage of one fluid stream into the other. A success rate far above 99.99% is typically required. For example, if a tube-to-header plate joining process with a 99.5% success rate is used to join tubes to header plate on a product with 100,000 tubes, then each of the two header plates will have 500 leaks. Even if the success rate is 99.9%, each header will have 100 leaks. A success rate of 99.99% would still result in 10 leaks in each header. Similarly, a heat exchanger with one million tubes and a success rate of 99.99% would have 100 leaks in each header. Identifying and patching tens or hundreds of leaks would be time consuming and expensive. An approach that results in zero, one, or two leaks would allow the manufacturer to produce the product much more inexpensively. A heat exchanger with 100,000 tubes (200,000 header plate-tube joints) with one leak will produce a success rate equal to 99.9995%. Of course, zero leaks is far more preferable than even one leak. Regarding micro tube heat exchangers, achieving such a success rate in excess of 99.9995% is important and may impact the commercial viability of the micro tube heat exchanger.

Still yet another challenging component of the manufacture of micro tube heat exchangers is the process by which tubes are inserted. Normally tube heat exchangers involve hundreds or even thousands of tubes, and it may be important to control the costs associated with tube insertion. For the case of micro tube heat exchangers, the problem associated with tube insertion cost is magnified greatly because the number of tubes is extremely high, even for relatively small, mass produced products. For at least the foregoing reasons, it has now become apparent that a need exists for a method to manufacture micro tube heat exchanger that allows for the quick and inexpensive insertion of thousands to millions of tubes through the header and/or mid plates, as well as facile methods of fabricating the header plates and of joining the tubes to header plate(s) so as to form substantially leak-free seals therebetween.

The present invention is deemed to meet the foregoing need, amongst others, by providing manufacturing methods to greatly reduce the cost and time of manufacturing micro tube heat exchangers. Specifically, at least one embodiment of the invention addresses one or more of the three manufacturing issues (header and mid plate manufacture, highly reliable bonding of tubes to the headers, and tube insertion) that are important components of overall cost and efficiency.

An embodiment of this invention is a method comprising disposing a first end plate adjacent to a second end plate, wherein the first end plate and second end plate each define a pattern of apertures. The first end plate is aligned with the second end plate such that the pattern of apertures in the first end plate is substantially aligned with the pattern of apertures in the second end plate. The method further comprises placing an end portion of each of a plurality of micro tubes in contact with the first end plate, the micro tubes being substantially vertically disposed and substantially perpendicular to a top surface of the first end plate, so as to place the micro tubes on the first end plate, and vibrating at least one of the micro tubes while the micro tubes are on the first end plate, thereby causing the micro tubes to insert into and through respective aligned apertures of the patterns of apertures in the first end plate and the second end plate. The method further comprises separating the first end plate from the second end plate while the micro tubes extend therethrough, until the first end plate and the second end plate are disposed proximate to respective end portions of the micro tubes extending therethrough, and affixing each end portion of the micro tubes to a respective end plate, thereby forming a pathway in a micro tube heat exchanger component for the flow of an internal fluid to be heated or cooled by external flow of an external fluid. It will be appreciated that, as used throughout this disclosure, the term vibrating means to cause to move to and fro, side to side and/or up and down.

Another embodiment of this invention is a method comprising disposing at least one mid plate adjacent to a first end plate and a second end plate thereby forming a stack, wherein the mid plate, the first end plate, and the second end plate each define a pattern of apertures. The mid plate, the first end plate, and the second end plate are aligned such that the pattern of apertures in each of the mid plate, the first end plate, and the second end plate is substantially aligned in the stack. The method further comprises placing an end portion of each of a plurality of micro tubes in contact with the first end plate, the micro tubes being substantially vertically disposed and substantially perpendicular to a top surface of the first end plate, so as to place the micro tubes on the first end plate, and vibrating at least one of the micro tubes while the micro tubes are on the first end plate, thereby causing the micro tubes to insert into and through respective aligned apertures of the patterns of apertures in the stack. The method further comprises separating the stack while the micro tubes extend therethrough, until the first end plate and the second end plate are each disposed proximate to respective end portions of the micro tubes extending therethrough and the mid plate is disposed at a selected location between the first end plate and the second end plate, and affixing each end portion of the micro tubes to a respective end plate, thereby forming a pathway in a micro tube heat exchanger component for the flow of an internal fluid to be heated or cooled by external flow of an external fluid.

In another aspect of the invention there is provided a method for fabricating a heat exchanger header while sealing a plurality of microtubes thereto. The method comprises providing a stack of a plurality of lamina each of which defines a pattern of lamina apertures, the apertures being substantially alignable in the stack;

disposing a plurality of microtubes through respective aligned lamina apertures extending through and defined by the stack of lamina so as to form a subassembly, a clearance existing between each of the microtubes and their respective aligned apertures when the microtubes are so disposed; and adhering together the lamina in the stack and the plurality of microtubes so disposed while forming a seal at the clearances.

Still another aspect of the invention provides a method of fabricating a heat exchanger, comprising threading a plurality of microtubes through respective, substantially aligned apertures formed by adjacent, stacked lamina, the microtubes and the lamina through which they are thread defining clearances;

separating at least some of the stacked lamina to form separate groups of one or more header lamina and one or more support lamina while the microtubes remain threaded therethrough, and disposing one or more of the support lamina at different respective points along a length of the microtubes; and adhering the header lamina to the plurality of microtubes threaded therethrough while forming a seal at the clearances These and other embodiments, advantages and features of this invention will be still further apparent from the ensuing detailed description, drawings and appended claims.

BRIEF DESCRIPTION OF THE DRAWINGS

In each of the above figures, like numerals are used to refer to like or functionally like parts among the several figures.

Further Detailed Descriptin of the Invention

Illustrative embodiments of the invention are described below as they might be employed in the method of manufacturing a heat exchanger according to the present invention. It will be of course appreciated that in the development of an actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 1:
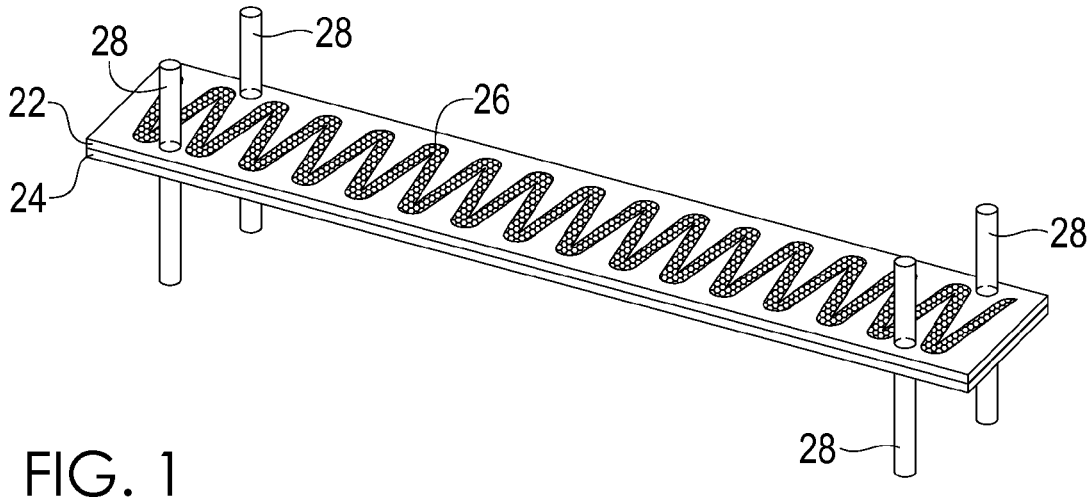
FIG. 1 is a perspective view of a first end plate adjacent to a second end plate, wherein the plates are aligned by a plurality of alignment pins consistent with one embodiment of the present invention.
Figure 9:
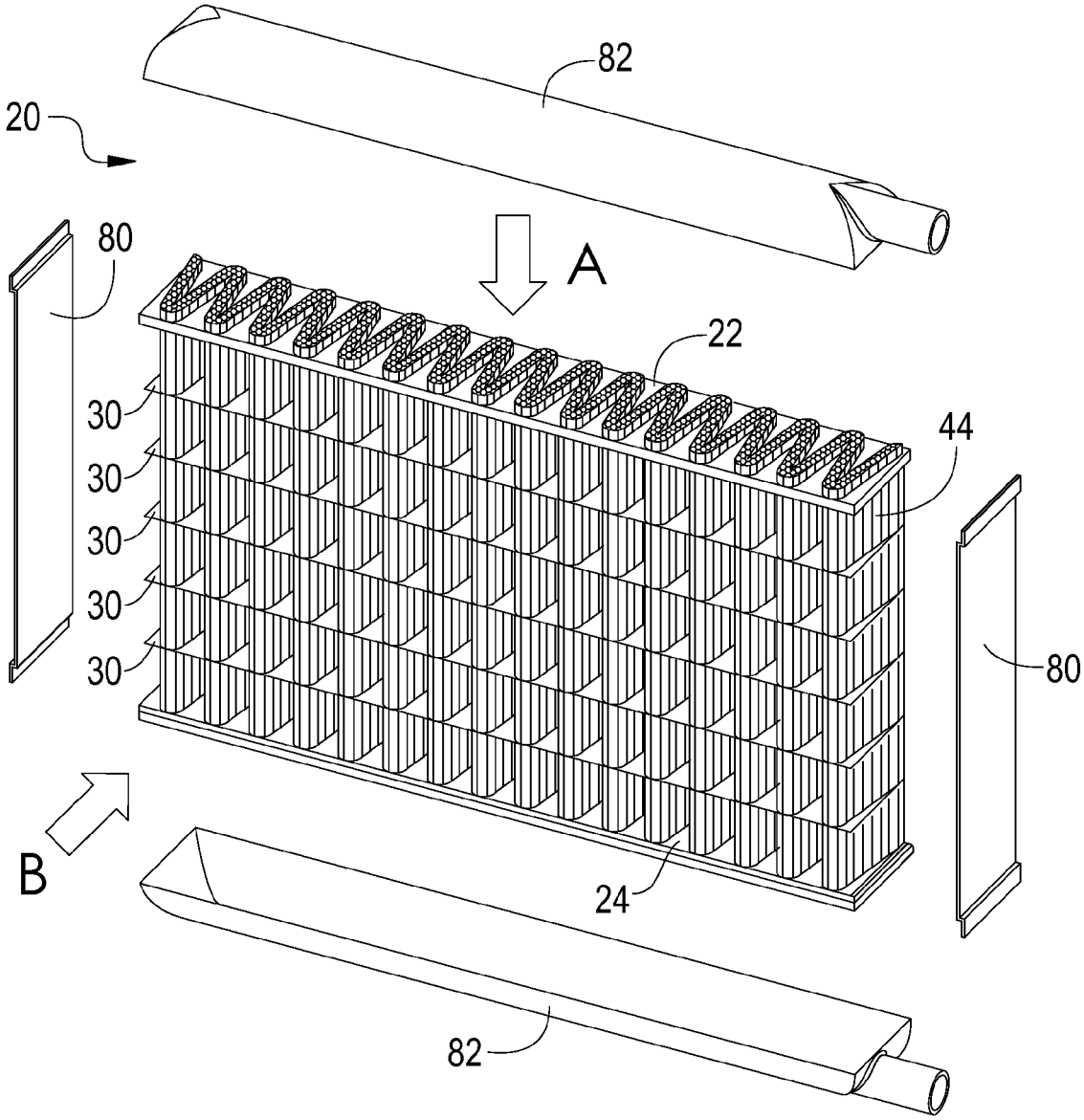
FIG. 9 is an exploded view of a heat exchanger core wherein end plates are affixed to a plurality of tubes forming the core consistent with one embodiment of the present invention.

Turning now to the Figures, one embodiment of the present invention includes a method for manufacturing a heat exchanger component 20 as shown in FIG. 9. As shown in FIG. 1, in at least one embodiment, two end plates may be provided wherein the end plates provided are a first end plate 22 and a second end plate 24. The first end plate will be disposed adjacent to the second end plate. The first end plate and the second end plate each define a pattern of apertures 26. As the first end plate is disposed adjacent to the second end plate, the plates will be aligned such that the pattern of apertures in the first end plate is substantially aligned with the pattern of apertures in the second end plate. A plurality of alignment pins may be placed in respective apertures in the pattern of apertures once the pattern of apertures of the first end plate and the second end plate are substantially aligned. In an alternate embodiment, each end plate defines a plurality of alignment pin apertures, wherein the alignment pins 28 are inserted into and through the alignment pin apertures. Multiple alignment pins may be placed in respective apertures in the pattern in at least one embodiment. The alignment pins may be used to keep the end plates substantially aligned.

Figure 2:
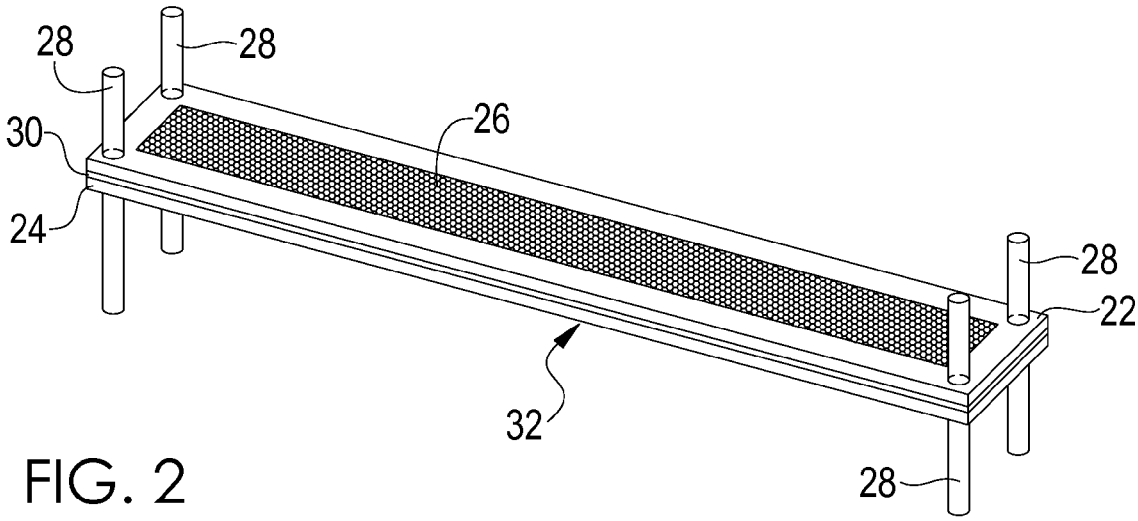
FIG. 2 is a perspective view of a mid plate adjacent to a first end plate and second end plate, wherein the mid plate, first end plate, and second end plate form a stack and wherein the plates forming the stack are aligned by a plurality of alignment pins consistent with one embodiment of the present invention.

As illustrated in FIG. 2, in an alternate embodiment, at least one mid plate 30 is disposed between the first end plate 22 and second end plate 24 disclosed above. Each mid plate will be disposed between the first and second end plate and will define a pattern of apertures 26, wherein the pattern of apertures will be substantially identical to the pattern of aperture of the end plates. Each mid plate will be substantially aligned with any other mid plate and further aligned with the end plates such that the pattern of apertures of each plate are substantially aligned. Alignment pins may be placed through at least one aperture in each mid plate in addition to the end plates in order to keep the pattern of apertures of each plate substantially aligned. In an alternate embodiment, each end plate and mid plate defines a plurality of alignment pin apertures, wherein the alignment pins 28 are inserted into and through the alignment pin apertures. The number of mid plates used may be dependent, amongst other factors, on the physical characteristics, such as size of the micro tube heat exchanger needed and/or the fluids subject to the heat exchanger. The substantially aligned first end plate, second end plate, and mid plate may form a stack 32. The thickness of the stack may depend on the thickness of each plate and also the number of mid plates chosen to be employed in the heat exchanger.

In one embodiment, the aligned first end plate and second plate are disposed in an assembly device comprising a first end portion and a second end portion, wherein the aligned first end plate and second end plate are retained proximate the first end portion of the assembly device. In an alternate embodiment illustrated in FIGS. 3A and 3B, a stack 32 formed from the first end plate 22, the second end plate 24, and at least one mid plate 30 is disposed in an assembly device 36 comprising a first end portion 38 and a second end portion 40, wherein the stack is retained proximate the first end portion of the assembly device. In at least one embodiment, at least one retention mechanism 42 will be applied to the end plates and optionally, the mid plates. The retention mechanism applied may be any mechanism functional to keep the plates together and proximate the first end portion of the assembly device while the tubes 44 are being inserted into and through the plates, which will be discussed further below. One such nonlimiting example may be a flange threaded onto a bolt attached to the assembly device, wherein the aligned first end plate and second end plate or, optionally, the stack is disposed upon and retained by the lip of the flange. Several bolts and flanges may be used to retain the plates. Additional retention mechanisms may include dissolvable glue, adhesive tape, and the like. It should be apparent that various retention mechanisms may be imagined and still fall within the scope of the present invention. Such retention mechanisms should retain the plates of the stack adjacent to the first end portion of the assembly device and in substantial alignment and should not impede the travel of the micro tubes into and through the pattern of apertures.

In one embodiment, the assembly device may be an assembly jig comprising a first end portion, a second end portion spaced and opposite the first end portion, and at least two support members, wherein the support members support the first end portion and the second end portion and provide the spacing between the end portions. In one embodiment illustrated in FIG. 3A, the assembly jig 36 comprises four support members 46 in the form of metal rods. First end portion 38 further defines a plate opening 48, wherein the opening is defined by the dimensions of the aligned first end plate and second end plate or the stack 32. First end portion may further defined bolt apertures 52 around the perimeter of the plate opening, whereby the retention mechanism including the bolt and flange disclosed above may be attached to the assembly device.

Figure 3A:
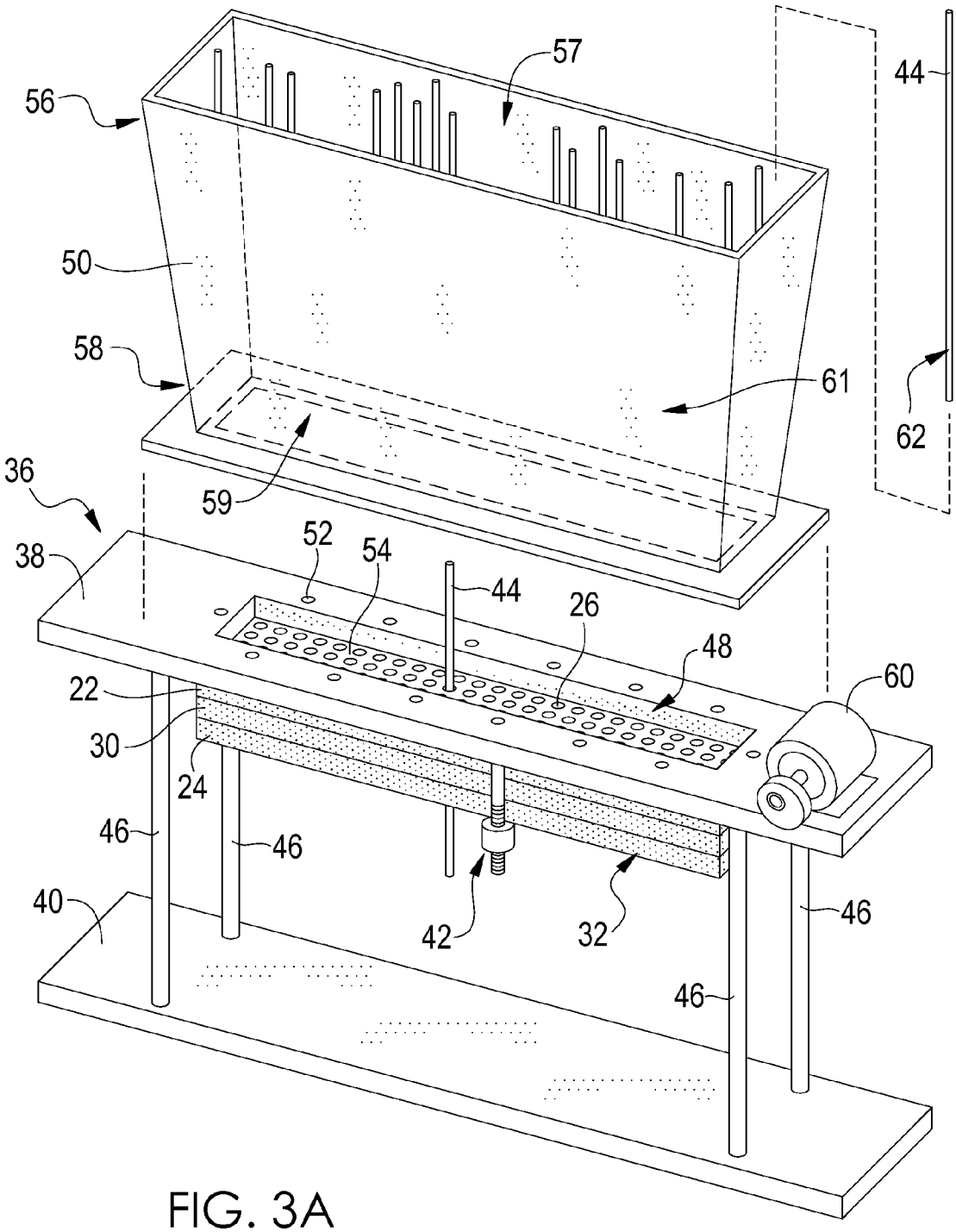
FIG. 3A is a perspective view of a stack disposed and retained in an assembly device, wherein a receptacle is proximate the assembly device, and a plurality of micro tubes is vertically disposed in the receptacle, wherein at least one end portion of the micro tubes is in contact with the top surface of a first end plate of the stack consistent with one embodiment of the present invention.
Figure 3B:
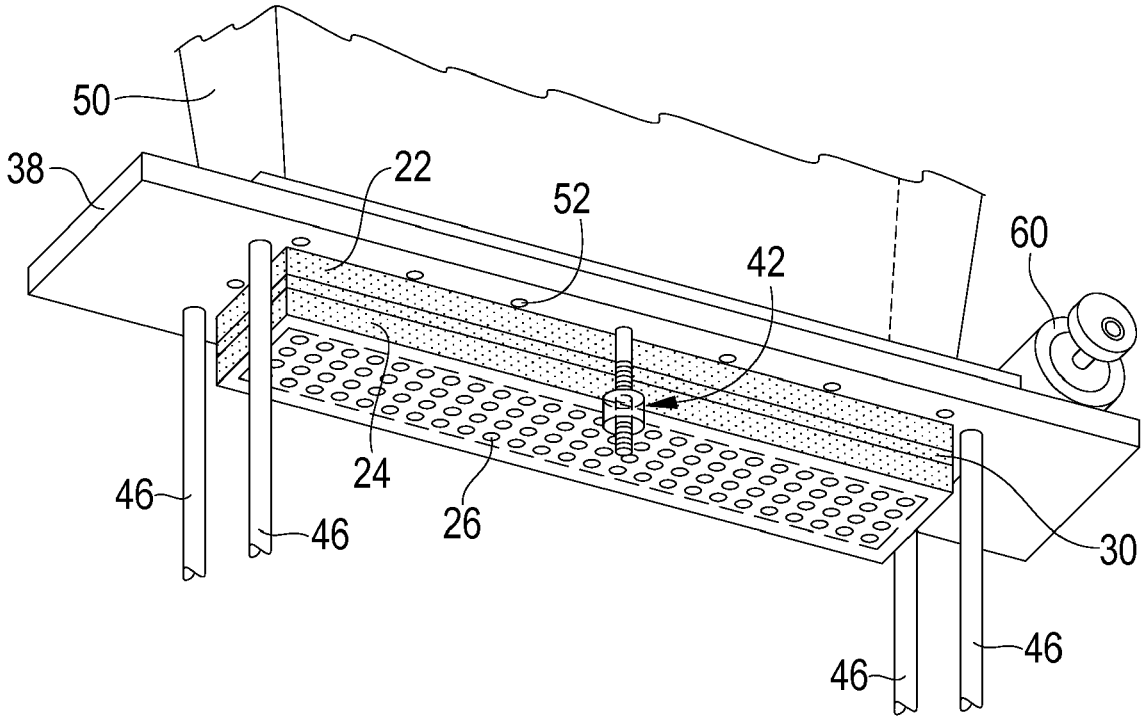
FIG. 3B is a perspective view of a stack disposed and retained in an assembly device, wherein the retention mechanism retains the stack proximate the assembly device consistent with one embodiment of the present invention.
Figure 4:
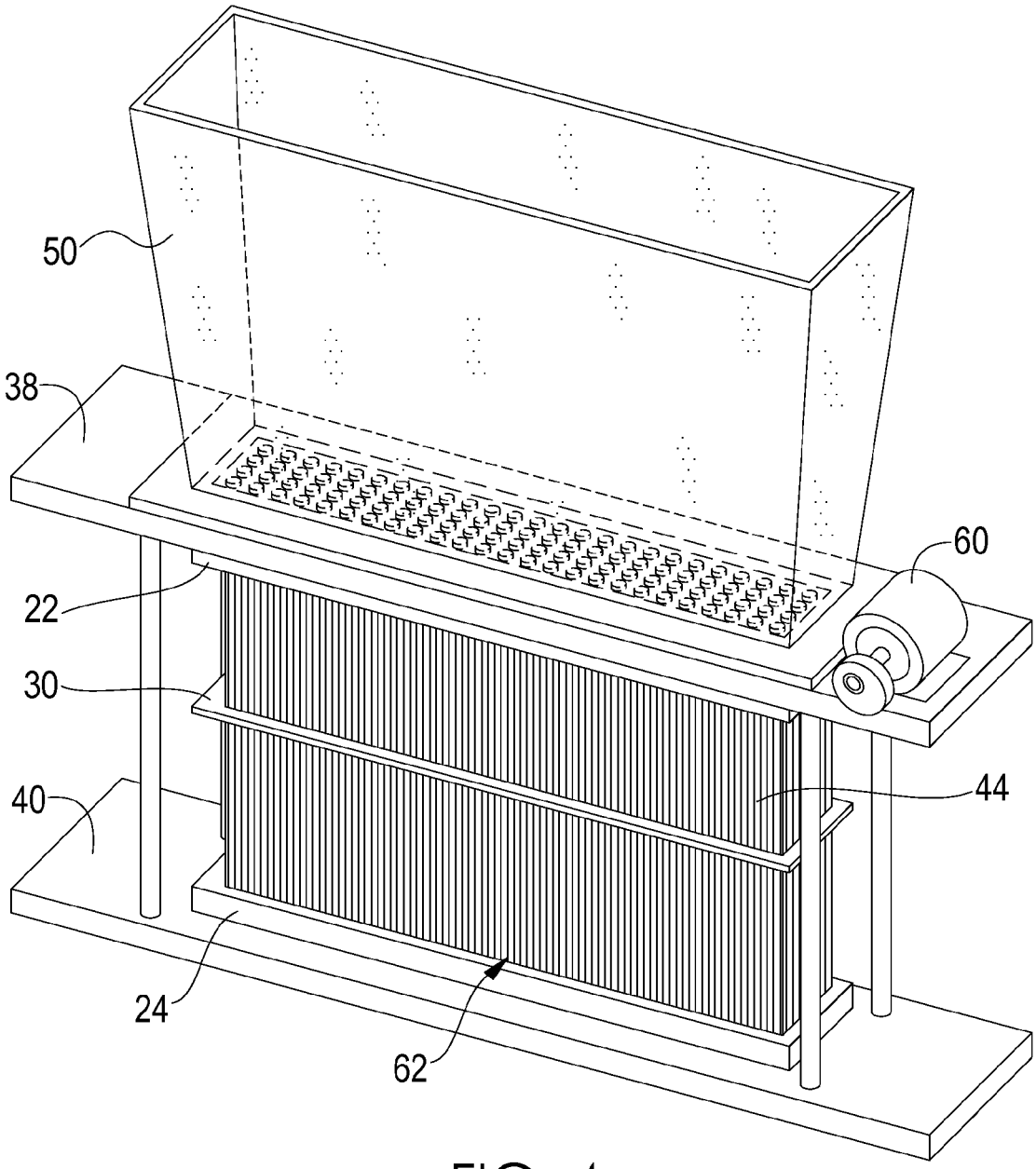
FIG. 4 is a perspective view of an assembly device wherein first end plate and second end plate are disposed proximate to respective end portions of a plurality of micro tubes extending therethrough and a mid plate is disposed in a selected location between the first end plate and second end plate consistent with one embodiment of the present invention.

As shown in FIGS. 3A and 4, a receptacle 50 may be disposed proximate to the assembly device. In one embodiment, the receptacle comprises at least one opening, wherein the opening of the receptacle is disposed proximate the first end portion of the assembly device. The plurality of micro tubes 44 may be fed into the receptacle and urged by gravity through the opening into contact with the top surface 54 of the first end plate 22. In one embodiment, the receptacle 50 may be a hopper, wherein the hopper comprises a feeder end portion 56 and a dispenser end portion 58. The feeder end portion and dispenser end portions define a feeder end opening 57 and a dispenser end opening 59 respectively. The hopper further defines an internal chamber 61 serving as a passageway connecting the feeder end opening and dispenser end opening. The micro tubes 44 may be fed into the feeder end opening and are substantially vertically disposed within the hopper. The tubes are urged by gravity through the dispenser end opening wherein an end portion 62 of each of a plurality of micro tubes is placed in contact with the first end plate 22, the micro tubes being substantially vertically disposed and substantially perpendicular to a top surface 54 of the first end plate, so as to place the micro tubes on the first end plate. It should be appreciated that some of the micro tubes urged by gravity through the hopper will fall directly through respective apertures 26 in the end plates and, optionally, the mid plates. These micro tubes will not contact the top surface of the first end plate, but rather will fall directly through the respective apertures in the end plates or stack. It should be appreciated that other manners may be employed to feed the tubes into and through the respective apertures including the use of an automated machine, wherein the tubes are inserted into and through the respective apertures.

In one embodiment, the receptacle may comprise a plurality of alignment members, wherein the alignment members may extend into the internal cavity of the receptacle. The alignment members allow for the positioning of the plurality of micro tubes in a substantially vertically disposed manner in the receptacle. The alignment members may be placed in a variety of locations in the receptacle, the locations depending, amongst other factors, on the number of micro tubes fed into the receptacle and the size and configuration of the receptacle. In at least one embodiment, the alignment members may be metal prongs extending into the cavity of the hopper, wherein the prongs function to dispose the micro tubes substantially vertically in the hopper.

As shown in FIGS. 3A and 4, in order to further cause the micro tubes 44 to insert into and through respective aligned apertures 26 of the patterns of apertures in the aligned first end plate and second end plate or the stack 32, a vibration source 60 may be attached to the receptacle 50 and/or the aligned first end plate and second end plate or stack and/or the assembly device 36. In one embodiment, the vibration source is an eccentric cam vibrator attached to the assembly device. The vibration source vibrates the assembly device further causing at least one, and preferably all, of the micro tubes to vibrate thereby causing the micro tubes to insert into and through respective aligned apertures 26 of the patterns of apertures in the first end plate 22 and the second end plate 24. By applying a vibration source to the micro tubes either directly or indirectly, the micro tubes are kept in continuous motion on the top surface of the first end plate until each micro tube is inserted into and through the respective aligned aperture of the patterns of apertures in the first end plate and the second end plate or the stack. The vibration source may vibrate at an optimal frequency, wherein the optimal frequency may be dependent on the physical characteristics of the assembly device and/or the manufactured heat exchanger.

In certain embodiments, each of the plurality of micro tubes may not be inserted into and through a respective aperture in the pattern of apertures by the force of gravity or the additional vibration applied directly or indirectly to the micro tube. In at least one embodiment, at least one micro tube is manually inserted into and through a respective aperture in the pattern of apertures in the aligned first end plate and second end plate or stack. It should be appreciated that manually inserting the micro tubes may be accomplished by guiding each tube through a respective aperture by hand or other convenient method apparent to those of skill in the art.

As illustrated in FIG. 4, in at least one embodiment, the first end plate 22 is separated from the second end plate 24 while the micro tubes 44 extend therethrough, until the first end plate and the second end plate are disposed proximate to respective end portions 62 of the micro tubes extending therethrough. In an alternate embodiment, at least one mid plate 30 is separated from the first end plate and the second end plate while the micro tubes extend therethrough, until the first end plate and the second end plate are disposed proximate to respective end portions of the micro tubes extending therethrough and the mid plate is disposed at a selected location between the first end plate and the second end plate. The selected location on the mid plate will be a design consideration dependent, amongst other considerations, on the physical characteristics of the heat exchanger and the number of mid plates used in the heat exchanger.

The plurality of micro tubes will be substantially parallel to each other and may be substantially perpendicular to a planar surface of the first end plate and second end plate and, optionally, the mid plates once the plates have been separated. In at least one embodiment, the micro tubes are substantially parallel to each other and substantially perpendicular to a planar surface of the separated plates.

Figure 5:
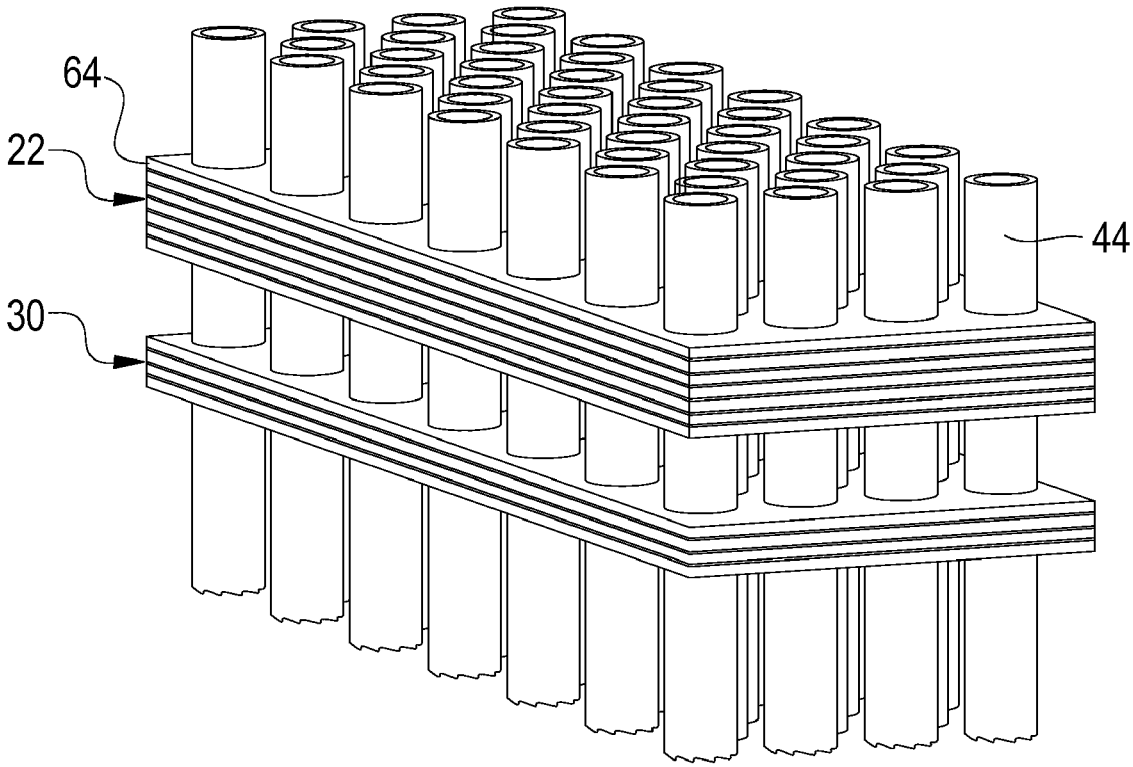
FIG. 5 is perspective view of a first end plate and mid plate, wherein the end plate and the mid plate are formed from a plurality of lamina consistent with one embodiment of the present invention.

In at least one embodiment, end plates are formed from one or more lamina 64 as shown in FIG. 5. It should be appreciated that each end plate (first end plate 22 shown), illustrated in the figure as a header plate, must be thick enough to satisfy structural requirements, and the apertures (not shown) in the header plate must have accurate tolerances both in absolute position (within a fraction of 0.001 inch (0.00254 cm)) as well as diametrical tolerance (within a fraction of 0.001 inch (0.00254 cm)) to ensure that tubes 44 can easily be fed through the stack of header plates and mid plates 30.

Both end plates and mid plates may be made of one or more lamina of thin sheets, either metal or polymer, each having the desired hole pattern. These lamina are made via lithographic etching, or stamping, or drilling and either process can produce the required lamina from a variety of metal alloys, e.g., steel, nickel alloy, aluminum, titanium or the like, or from a polymer.

The lamina that are used to make the header plate and mid plates can be made lithographically by selective etching. Typically, the allowable thickness of lithographically etched sheet is on the order of one half of a hole diameter. If the thickness of the sheet is much greater than half of the hole diameter, then side wall taper will be excessive and control of hole quality is lost. Typical micro tube diameters are 0.5 millimeters in diameter, so the allowable thickness of the etched sheets is about 0.25 millimeters (which is about 0.010 inches).

Figure 6:
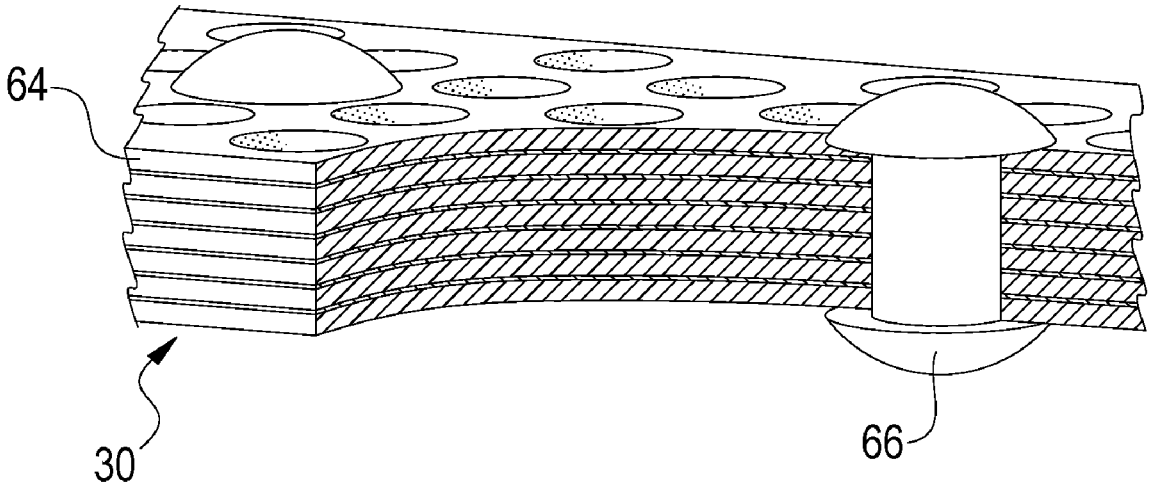
FIG. 6 is a cutaway, cross-sectional view of a plurality of lamina held together by rivets consistent with one embodiment of the present invention.

In certain embodiments, end plates may comprise a plurality of lamina (whose thickness is on the order of 0.010 inches (0.25 mm)). Accordingly, in certain embodiments, mid plates may also comprise one or a plurality of lamina. Stacks of lamina 64, either for mid plates 30 or end plates are aligned, then joined together in one or more of a multiple of ways, e.g., rivets, spot welding, brazing, adhering, and the like as illustrated in FIG. 6, wherein the stacks of lamina 64 are joined by rivets 66. The stacking and subsequent joining process results in the end plate or mid plates that can then be used as monolithic parts which are used in the end plates and mid plate stack prior to tube insertion.

End plates and, when present, mid plates, each define a pattern of apertures. The patterns of apertures in each of the end plates used in a heat exchanger may be substantially identical. In embodiments including a mid plate, the pattern of apertures defined by the mid plate may be substantially identical to the pattern of apertures defined by the end plates. The pattern of apertures defines the spacing/position of the micro tubes in the heat exchanger. The pattern of apertures may vary. Nonlimiting examples of patterns include serpentine patterns, rectangular arrays, square arrays, and random patterns. As described below, each aperture typically will be circular and substantially geometrically equivalent to every other aperture in the pattern. However, other aperture shapes may be contemplated and remain within the scope of the present invention.

Etched and stamped parts allow for lithographically defining a non-circular hole as a circular hole. The ability to etch non circular holes becomes useful when the cross section of the micro tubes is non circular. Typically, the shape of the micro tubes will dictate the shape of each aperture in the pattern of apertures. However, the dimensions of the apertures in the pattern of apertures may define the dimensions of the micro tubes used. While circular micro tubes may be beneficial due to availability and cost, the fact that header and spacer plates can easily be manufactured which accommodate other tube cross section shapes means that tube cross section is a choice the designer will select, but is not a parameter by itself that uniquely differentiates micro tube heat exchangers.

In at least one embodiment, a plurality of micro tubes 44 will be provided as illustrated in FIG. 9. The number of tubes provided will depend on the design chosen and the performance requirements desired. In certain embodiment, the heat exchanger will utilize thousands, tens of thousands, or even millions of tubes. As stated above, micro tubes may have an outer diameter of less than 1.0 mm. Micro tubes typically may be made from polymer or metal alloys. Such metal alloys may include, e.g., steel, nickel alloy, aluminum, or titanium. The end plates, mid plates, and micro tubes of the heat exchanger can be made from the same material or, for example, the heat exchanger may comprise end plates and mid plates made out of one material and micro tubes made from a different material. The material used in making the heat exchanger may be selected based on performance standards or physical requirements. For example, the heat exchanger may be composed of stainless steel in high temperature operations or environments requiring high tensile strength. Aluminum may be chosen as a suitable material in order to decrease the weight of the heat exchanger. Such examples are nonlimiting and it should be apparent that one of ordinary skill in the art may choose the heat exchanger materials for a desired result based on the applicable factors.

In one embodiment, the micro tubes are resized, wherein the micro tubes are cut to an appropriate length for a desired dimension of the micro tube heat exchanger component. the micro tubes may come in original form wrapped around a spool, wherein the length of the micro tubes may need to be modified to an appropriate size based on the dimensions of the desired heat exchanger. It should be appreciated that the micro tubes may be cut by any manner known in the art.

Figure 7:
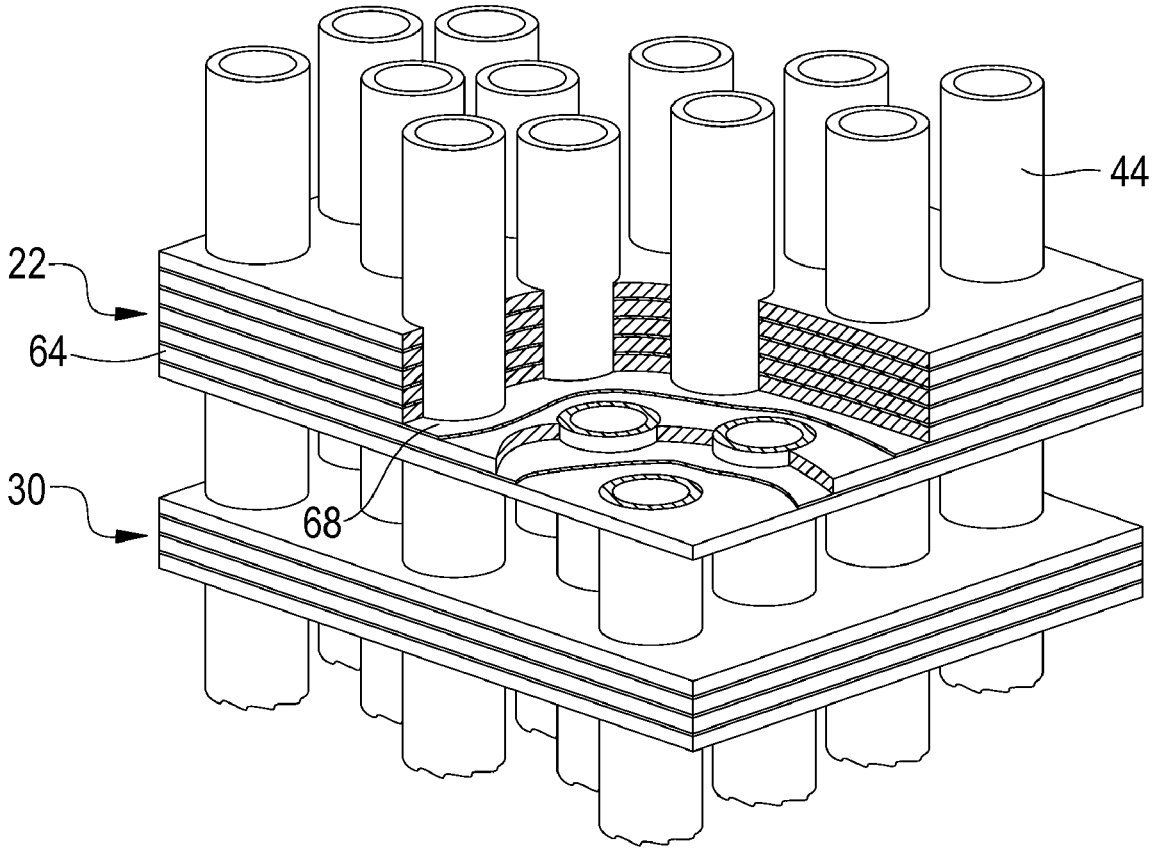
FIG. 7 is a cutaway, cross-sectional view of a plurality of micro tubes affixed to a first end plate by braze lamina consistent with one embodiment of the present invention.

The micro tubes are affixed to the end plates and, optionally, the mid plates. The micro tubes should be joined to the end plates and, optionally, the mid plates via a sealant to prevent flow through the gap between each of the tubes and their respective aperture of the pattern of apertures. In one embodiment illustrated in FIG. 7, the micro tubes 44 are affixed to the end plates (first end plate 22 shown) and optionally, the mid plates 30, by braze lamina 68. As illustrated in FIG. 7, a derivative of the lamination process uses alternating layers of base metal lamina 64 and braze lamina. In brazing, the braze filler material is applied either as a paste, wire, coating or foil to the regions where the braze joints are needed. When the laminated plate is heated to the appropriate temperature, the braze melts and flows to surface tension-controlled clearances between layers of lamina, then freezes as the temperature is reduced. The appropriate temperature will depend upon the brazing material employed and the desired physical characteristics of the heat-treated braze. As is known by those of skill in the art, which braze material and which temperature is used for brazing component parts together will be a matter driven by application and the desired characteristics of the end product, with the temperature being selected typically in accordance with recommendations of the braze material supplier. To successfully braze a micro tube heat exchanger, braze material needs to be locally present at each aperture. If braze material is present in each aperture and other normal brazing procedures are satisfied (such as appropriate part cleanliness, appropriate part clearances, etc.) then there is a likely chance of a successful braze joint. The advantage of using alternating layers of metal and braze lamina to make a laminated header or mid plate is that braze is guaranteed to be in close proximity to each aperture, and if more than one lamina of braze foil exist in the laminate, then redundant sources of braze will be in close proximity to each of the multitude of tube-header joints. The braze lamina are fabricated in ways similar to the metal lamina, either by lithographically-defined etching or by stamping. The laminate of alternating layers of metal and braze sheets are then joined together via rivets, spot welding, and the like, producing a monolithic plate that is then used as one of the stack of plates that defines the heat exchanger core.

Figure 8:
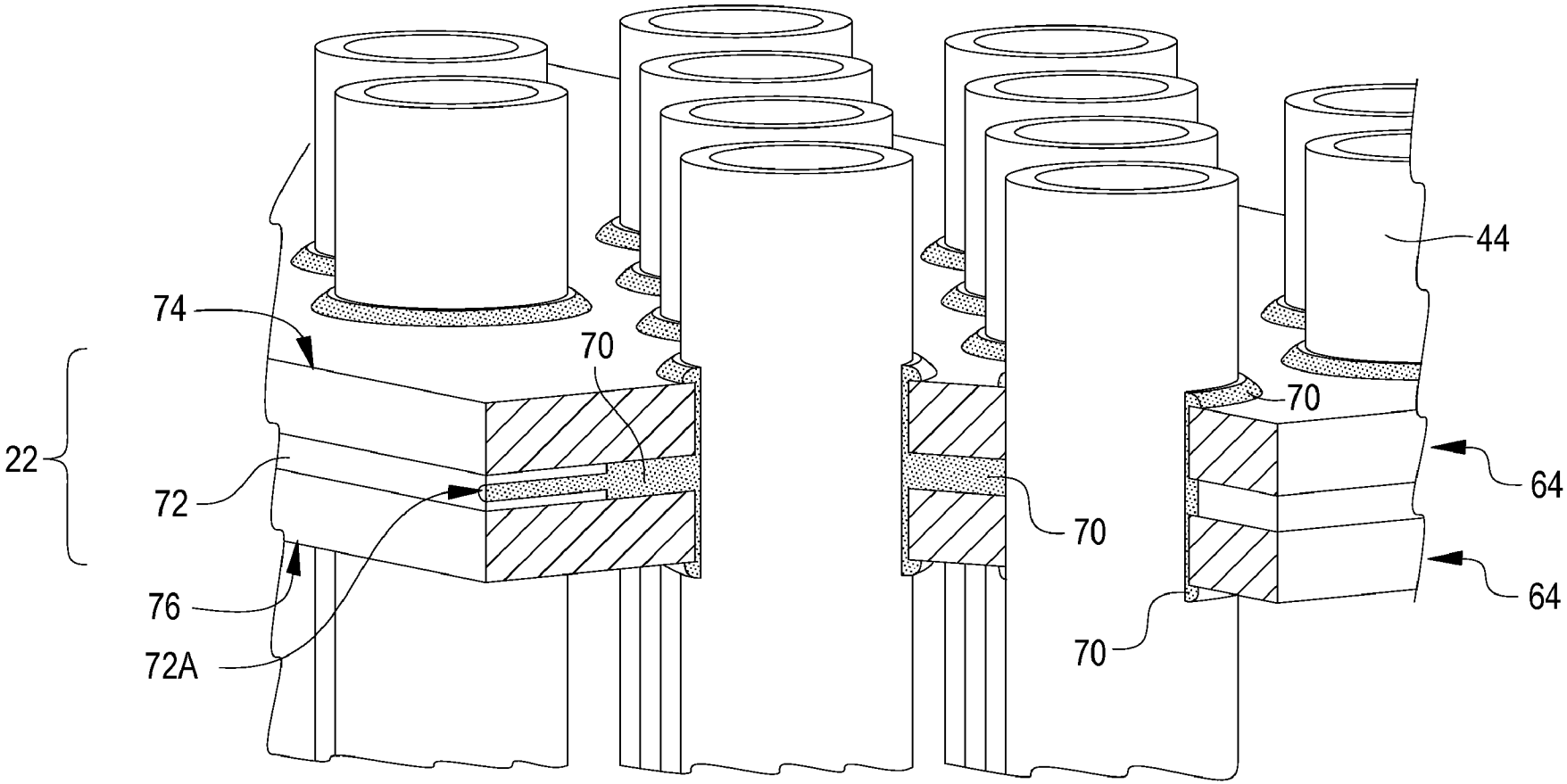
FIG. 8 is a cutaway, cross-sectional view of a plurality of micro tubes affixed to a first end plate by braze paste insertion consistent with one embodiment of the present invention.
Figure 8A:
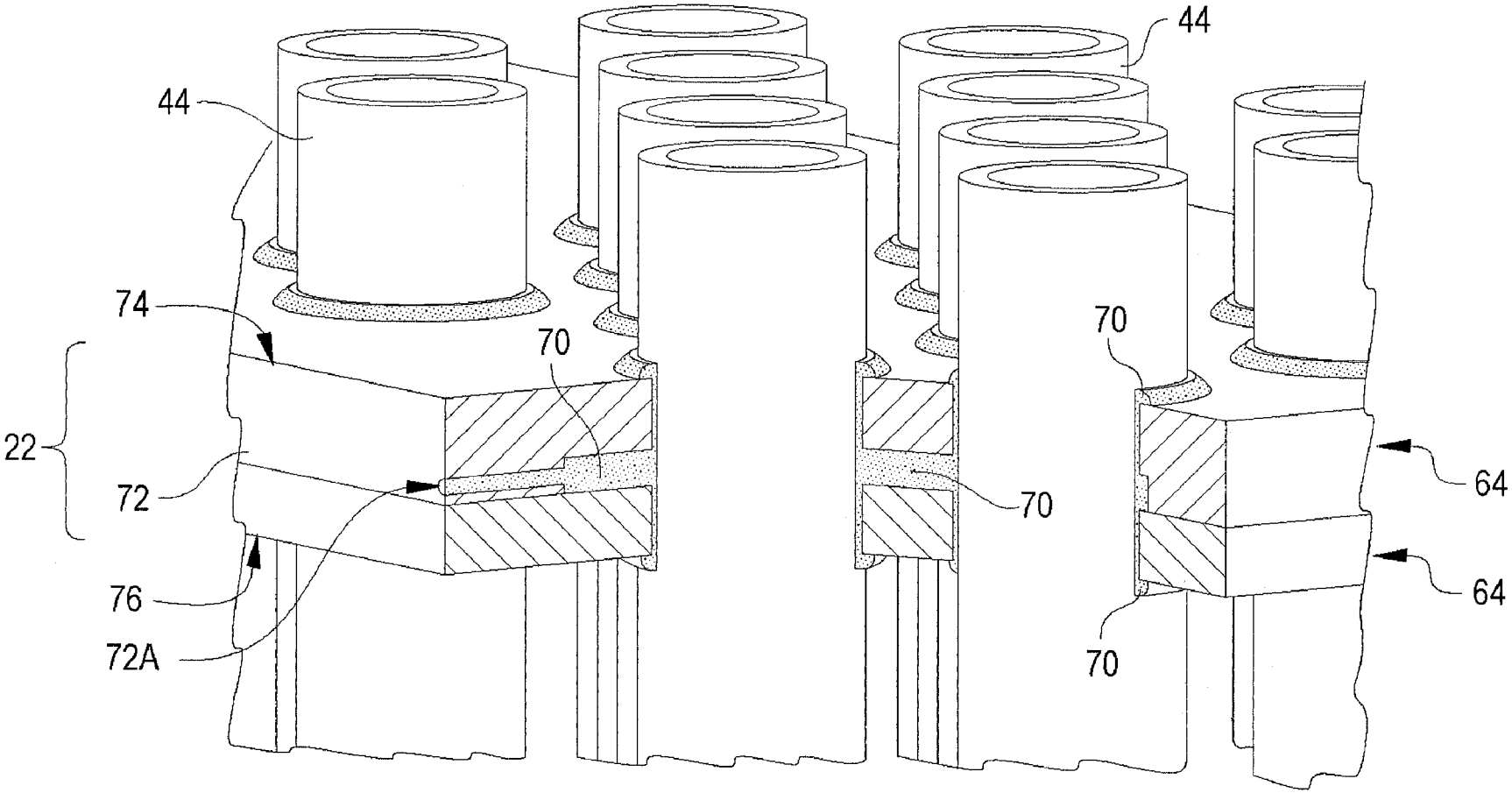
FIG. 8A is a cutaway, cross-sectional view of a plurality of micro tubes affixed to a first end plate by braze paste insertion consistent with another embodiment of the present invention.

In another embodiment illustrated in FIG. 8, the micro tubes 44 are affixed to the end plates (first end plate 22 shown) and optionally, the mid plates, by braze paste insertion. In some cases it may be preferable to use a braze paste 70 rather than the braze lamina approach previously described. In this case, the header is composed of two metal laminates, each consisting of two or more lamina 64. During the header plate-mid plate stacking process, a hollow spacer plate 72 is inserted between the two metal laminates that define the upper 74 and lower faces 76 of the header plate, or as shown in FIG. 8A, is integral with the laminate that forms upper face 74 of the header plate. After the tubes are inserted, the lamina parts are separated appropriately. Clamps and/or bonding methods (not shown) are used to clamp the edges of the two laminates to the spacer plate 72, when the spacer plate 72 is not an integral part of a laminate. The hollow spacer plate 72 (also referenced as portion 72 elsewhere in the figures showing integration into a laminate 64) serves to form a cavity into which braze paste can be injected between the laminates, e.g., through an injection port 72A. The paste flows relatively easily through the tube array-filled cavity; it flows under pressure through the gaps between tubes and header plates (both upper and lower). Eventually, some small amount of braze will ooze out of the space surrounding tubes on both the upper and lower faces, at which point no more braze paste is injected. The result of this process is a two layer header plate, each with the capability to seal, separated by the spacer plate 72 which is also brazed to both the upper and lower metal laminates 64, 64, when it is a separate piece, or simply brazed to an opposing laminate when it is an integral part of one of the laminates. Also, due to the I-beam construction of the header, it is extremely stiff.

Figure 8B:
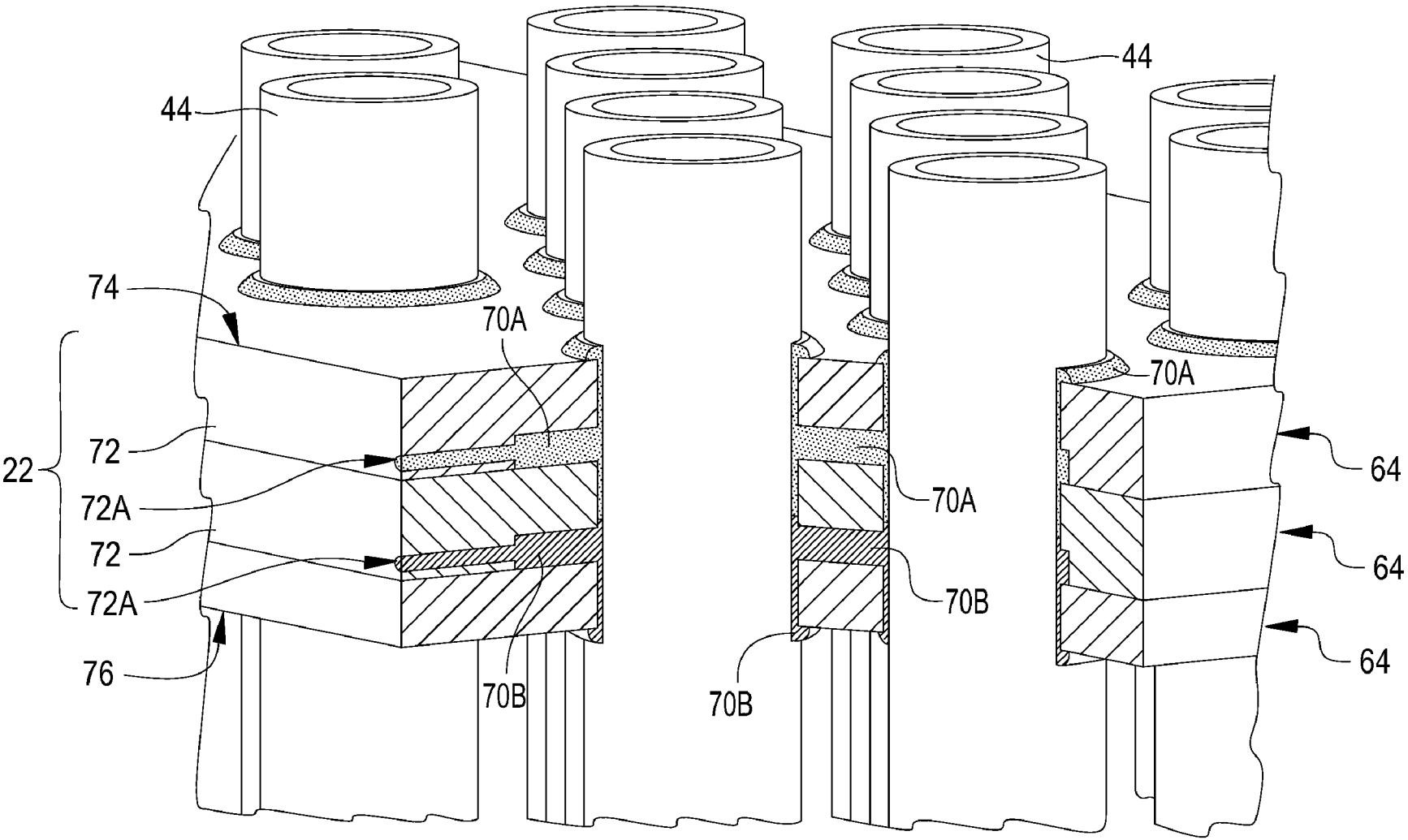
FIG. 8B is a cutaway, cross-sectional view of a device similar to FIG. 8A, using three laminates to form the header plate and multiple injection ports for using a combination of bonding material and a sealant.
Figure 8C:
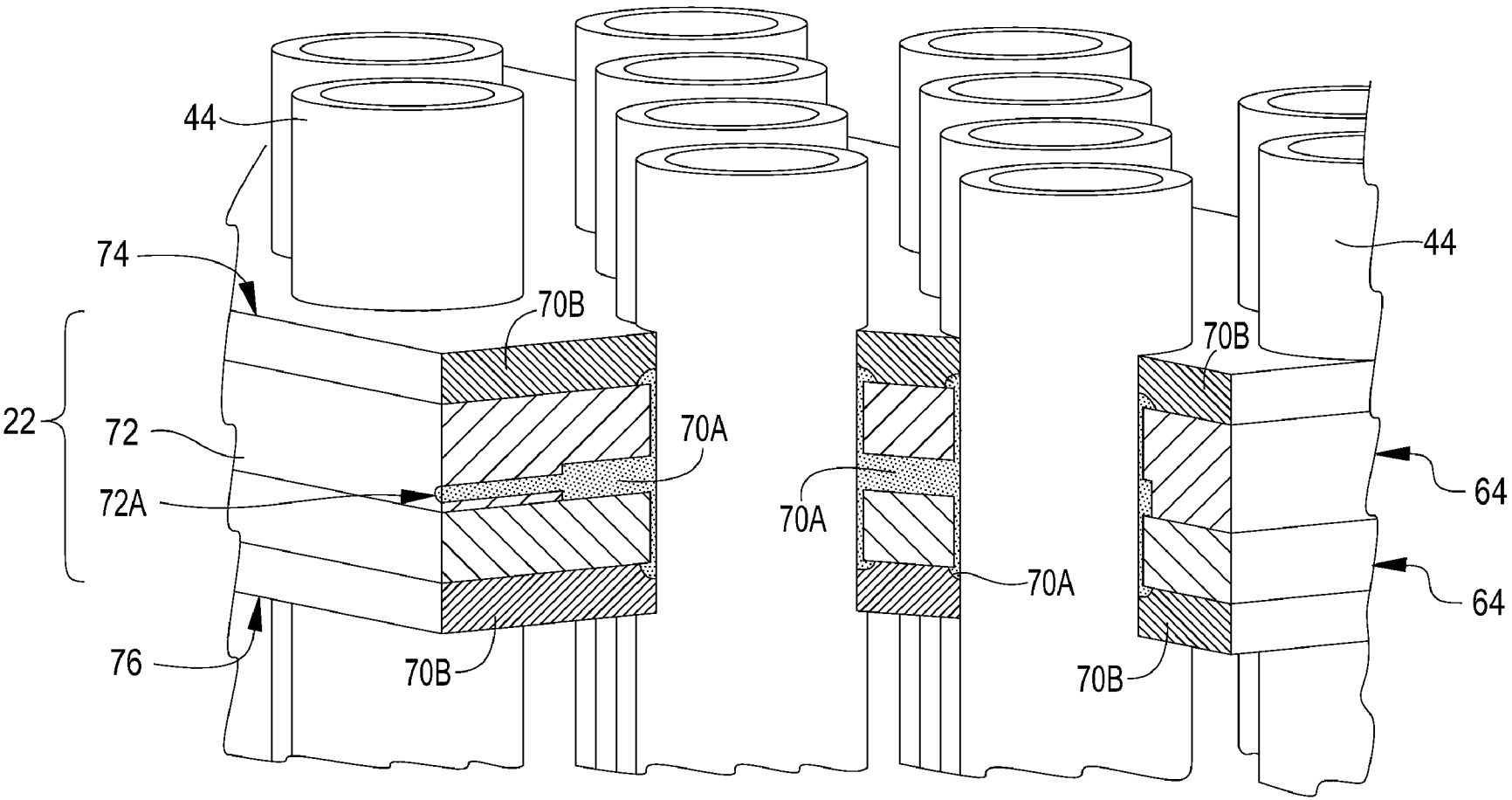
FIG. 8C is a cutaway, cross-sectional view of a device similar to FIG. 8B, using only two laminates to form the header plate and a single injection port, where bonding material is layered on the top and bottom surface of the header plate and sealant material is injected into the injection port.

In another embodiment, illustrated for example in FIG. 8B, the micro tubes are affixed to the end plates, and optionally, the mid plates, by adhesives. In general, an adhesive needs to perform two engineering functions: provide a seal between each tube and the header as well as rigidly bond each tube to the header to prevent relative motion between tube and header in a direction along the longitudinal axis of the tube. In some applications, a single adhesive may be used to provide both functions (sealing and bonding) simultaneously. In such a case, the product may look very similar to the scenario described in FIG. 8A, with the single type of adhesive taking the place of the braze paste. In other cases, it may be necessary to use two adhesives, with each of the two adhesives carrying the burden, respectively, of either providing bonding between tube and header, or a seal between tube and header. In such a case multi component headers such as shown in FIG. 8B may be used, where two separate adhesives are utilized (in this case, materials 70A and/or 70B). Note in FIG. 8B the presence of two different injection ports 72A, 72A by which the two adhesives can be injected between perspective lamina. A high strength epoxy 70B, for example, can be used to bond the tubes to the header, while a silicone or flexible, low strength epoxy 70A can be used to provide a seal between tubes and header. Control of process variables (such as the materials employed, speed of injection, temperature, size of part, etc.) results in a success rate of 100% of the joints sealed. Of course, those skilled in the art will understand that these process variables can vary from product to product, because of differences in geometry, materials employed, desired specifications and other practicalities. There may be some trial and error required in any given application in order to achieve a satisfactory level of sealing. Another embodiment of the two sealant approach is shown in FIG. 8C. In this case, one adhesive 70A is applied into the cavity between each header laminates, and the other adhesive 70B is applied to the top and/or bottom surfaces of the header plates. The adhesive can be applied under pressure into a cavity similar to that shown in FIGS. 8, 8A and 8B, or it can be applied to the top surface 74 and/or bottom surface 76, heated slightly (to reduce viscosity) and allowed to ooze into each tube-header plate gap in a manner consistent with FIG. 8C. In this way, tubes 44 are also bonded to the header plate at one or more of the laminates 64, and any seal leakage at the tube-header plate interface is avoided with the presence of a high-quality sealant in that space. Appropriate process control can make it possible to establish a "rivet" of adhesive on the bottom and/or top side of the header plate, with very little additional material flow. The result of the adhesive process is shown in FIG. 5. It should be appreciated that the number of lamina employed, the number of injection ports and the placement of different adhesives into the system can vary from that shown in the illustrative figures.

For those embodiments of the invention employing an epoxy bonding material and/or a silicone sealant material, examples of potentially suitable epoxies include ARATHANE 5753 from CIBA Specialty Chemicals Corp., New York, N.Y.; AREMCO BOND 2315 from Aremco Products, Inc., Valley Cottage, N.Y.; epoxies available from National Adhesives such as BONDMASTER ESP-308 and ESP-309; Emerson & Cuming's ECCOBOND A-359 and A-410-5P; epoxies available from Cotronics, such as DURALCO 4525, 4538, 4540 and 4700, DURABOND 455, 7025, 7032, 950, 950FS and 954, and RESBOND 989; epoxies from Loctite such as HYSOL 3141/3163, E-214HP, E-40HT, E-60NC and U-05FL (Urethane); JB-WELD epoxy; MASTERBOND EP29LPSP; Plastech-Weld epoxies such as MAX 5000 and RAD-120; and epoxies from Scotch-Weld such DP-8010, EC-2214, EC-2216 and EC-3710. Examples of potentially suitable candidate silicone material include DOW CORNING 734, 736, 832, 1-2577 and 9-1363; General Electric's RTV-157; Loctite's 587 BLUE 598, BLACK 5606, 5607, 5699, 5900, 5910, 2577 and SUPERFLEX #2 Gasket Sealant; and Momentive's RTV-100, 106, 116, 118 and 159, and Silicone Solutions' SS-6604.

Once the micro tubes are sealingly attached to the end plates, a heat exchanger core is formed and a pathway is formed in the micro tube heat exchanger component 20 for the flow of an internal fluid A to be heated or cooled by external flow of an external fluid B. As illustrated in FIG. 9, in at least one embodiment, at least two side plates 80 and/or a housing are attached to the first end plate 22 and the second end plate 24 and, optionally, the mid plate 30. The side plates and/or housing are mounted to define the geometry of the cross stream duct guiding flow over the outer (shell) side of the micro tubes. Additionally, side plates provide the heat exchanger with structural rigidity. The side plates and end plates and, optionally, the mid plates joined together provide the structural frame of the heat exchanger. In one embodiment, a manifold 82 is attached to a respective end plate 22, 24. The manifolds define the volume of the plenums at either end of the plurality of micro tubes. The side plates and/or housing and manifolds may be attached by brazing or adhesion.

In at least one embodiment, the heat exchanger is fabricated using polymer micro tubes, and may be fabricated using polymer mid plates, end plates, side plates, and manifolds. The end plates and mid plates may be metal or polymer. In the case where metal end plates are used, an adhesive is used to seal the micro tubes to the header plate. Preferably, the end plates and mid plates are made of a polymer if polymer micro tubes are used. A solvent or heat may be added to ensure that a chemical bond is established between the end plates, mid plate, and each micro tube.

The internal and external fluids may be a liquid or a gas. Depending on the operating conditions, particularly the temperature of the fluid to be cooled or heated, various external fluids may be used. It is to be understood that the chosen external or internal fluids should not degrade the heat exchanger component.

Except as may be expressly otherwise indicated, the article "a" or "an" if and as used herein is not intended to limit, and should not be construed as limiting, the description or a claim to a single element to which the article refers. Rather, the article "a" or "an" if and as used herein is intended to cover one or more such elements, unless the text expressly indicates otherwise.

This invention is susceptible to considerable variation within the spirit and scope of the appended claims.

The invention claimed is:

1. A method comprising disposing a first end plate adjacent to a second end plate, wherein the first end plate and second end plate each define a pattern of apertures, the first end plate being aligned with the second end plate such that the pattern of apertures in the first end plate is substantially aligned with the pattern of apertures in the second end plate;

placing an end portion of each of a plurality of micro tubes in contact with the first end plate, the micro tubes being substantially vertically disposed and substantially perpendicular to a top surface of the first end plate, so as to place the micro tubes on the first end plate;

vibrating at least one of the micro tubes while the micro tubes are on the first end plate, thereby causing the micro tubes to insert into and through respective aligned apertures of the patterns of apertures in the first end plate and the second end plate;

separating the first end plate from the second end plate while the micro tubes extend therethrough, until the first end plate and the second end plate are disposed proximate to respective end portions of the micro tubes extending therethrough; and affixing each end portion of the micro tubes to a respective end plate, thereby forming a pathway in a micro tube heat exchanger component for the flow of an internal fluid to be heated or cooled by external flow of an external fluid.

2. The method according to claim 1 further comprising disposing the aligned first end plate and second end plate in an assembly device comprising a first end portion and a second end portion, wherein the aligned first end plate and second end plate are retained proximate the first end portion of the assembly device.

3. The method according to claim 2 further comprising feeding the plurality of micro tubes into a receptacle comprising at least one opening, the opening of the receptacle disposed proximate the first end portion of the assembly device, wherein the plurality of micro tubes are urged by gravity through the opening into contact with the top surface of the first end plate.

4. The method according to claim 3 further comprising vibrating (i) the receptacle; and/or (ii) the aligned first end plate and second end plate; and/or (iii) the assembly device, causing at least one of the micro tubes to vibrate thereby causing the micro tubes to insert into and through respective aligned apertures of the patterns of apertures in the first end plate and the second end plate.

5. The method according to claim 4 further comprising manually inserting any of the plurality of micro tubes failing to be inserted into and through the pattern of apertures in the first end plate and the second end plate by vibrating at least one of the plurality of micro tubes.

6. The method according to claim 5 further comprising disposing a plurality of alignment pins in the apertures of the aligned first end plate and second end plate.

7. The method according to claim 6 further comprising brazing or adhering the end portion of each of the plurality of micro tubes to the respective end plate.

8. The method according to claim 7 further comprising attaching at least two side plates and/or a housing to the first end plate and the second end plate.

9. The method according to claim 8 further comprising attaching a manifold to the respective end plate.

10. The method according to claim 1 further comprising forming the first end plate and the second end plate, each end plate comprising at least one lamina.

11. A method comprising disposing at least one mid plate adjacent to a first end plate and a second end plate thereby forming a stack, wherein the mid plate, the first end plate, and the second end plate each define a pattern of apertures, the mid plate, the first end plate, and the second end plate being aligned such that the pattern of apertures in each of the mid plate, the first end plate, and the second end plate is substantially aligned in the stack;

placing an end portion of each of a plurality of micro tubes in contact with the first end plate, the micro tubes being substantially vertically disposed and substantially perpendicular to a top surface of the first end plate, so as to place the micro tubes on the first end plate;

vibrating at least one of the micro tubes while the micro tubes are on the first end plate, thereby causing the micro tubes to insert into and through respective aligned apertures of the patterns of apertures in the stack;

separating the stack while the micro tubes extend therethrough, until the first end plate and the second end plate are each disposed proximate to respective end portions of the micro tubes extending therethrough and the mid plate is disposed at a selected location between the first end plate and the second end plate; and affixing each end portion of the micro tubes to a respective end plate, thereby forming a pathway in a micro tube heat exchanger component for the flow of an internal fluid to be heated or cooled by external flow of an external fluid.

12. The method according to claim 11 further comprising disposing the stack in an assembly device comprising a first end portion and a second end portion, wherein the stack is retained proximate the first end portion of the assembly device.

13. The method according to claim 12 further comprising feeding the plurality of micro tubes into a receptacle comprising at least one opening, the opening of the receptacle disposed proximate the first end portion of the assembly device, wherein the plurality of micro tubes are urged by gravity through the opening into contact with the top surface of the first end plate.

14. The method according to claim 13 further comprising vibrating (i) the receptacle; and/or (ii) the stack; and/or (iii) the assembly device, causing at least one of the micro tubes to vibrate thereby causing the micro tubes to insert into and through respective aligned apertures of the patterns of apertures in the stack.

15. The method according to claim 14 further comprising manually inserting any of the plurality of micro tubes failing to be inserted into and through the pattern of apertures in the stack by vibrating at least one of the plurality of micro tubes.

16. The method according to claim 15 further comprising disposing a plurality of alignment pins in the apertures of the stack.

17. The method according to claim 16 further comprising brazing or adhering each end portion of the plurality of micro tubes to the respective end plate.

18. The method according to claim 17 further comprising attaching at least two side plates and/or a housing to the mid plate, the first end plate, and the second end plate.

19. The method according to claim 18 further comprising attaching a manifold to the respective end plate.

20. The method according to claim 11 further comprising forming the mid plate, the first end plate, and the second end plate, each of the mid plate, the first end plate, and the second end plate comprising at least one lamina.

21. The method according to claim 16 further comprising brazing or adhering each micro tube of the plurality of micro tubes to the mid plate.

* * * * *